US011234299B2

(12) United States Patent
Ratti et al.

(10) Patent No.: US 11,234,299 B2
(45) Date of Patent: Jan. 25, 2022

(54) SYSTEM FOR WARMING UP AND/OR COOKING FOOD WITH MICROWAVE DETECTION

(71) Applicant: WHIRLPOOL EMEA S.P.A., Pero (IT)

(72) Inventors: Carlo Filippo Ratti, Turin (IT); Marco Maria Pedrazzo, Cueno (IT)

(73) Assignee: Whirlpool Corporation, Benton Harbor, MI (US)

( * ) Notice: Subject to any disclaimer, the term of this patent is extended or adjusted under 35 U.S.C. 154(b) by 178 days.

(21) Appl. No.: 15/301,632

(22) PCT Filed: Apr. 1, 2015

(86) PCT No.: PCT/IB2015/052402

§ 371 (c)(1),
(2) Date: Oct. 3, 2016

(87) PCT Pub. No.: WO2015/155638

PCT Pub. Date: Oct. 15, 2015

(65) Prior Publication Data

US 2017/0111961 A1 Apr. 20, 2017

(30) Foreign Application Priority Data

Apr. 7, 2014 (IT) ..... TO2014A000289

(51) Int. Cl.
*H05B 6/64* (2006.01)

(52) U.S. Cl.
CPC ..... *H05B 6/6435* (2013.01); *H05B 6/6455* (2013.01)

(58) Field of Classification Search
CPC ..... H05B 6/6435; H05B 6/6447–6467; H05B 6/6482

(Continued)

(56) References Cited

U.S. PATENT DOCUMENTS 4,298,780 A * 11/1981 Suzuki ..... H05B 6/6482 219/685
4,426,572 A * 1/1984 Tachikawa ..... H05B 6/6482 219/502

(Continued)

FOREIGN PATENT DOCUMENTS

| | | | |
|---|---|---|---|
| EP | 1028604 | A2 | 8/2000 |
| EP | 2642822 | A1 | 9/2013 |
| JP | 2008286466 | A | 11/2008 |

OTHER PUBLICATIONS

The International Bureau of WIPO, "International Preliminary Report on Patentability", PCT Search Report, dated Oct. 12, 2016, 7 pages, Geneva, Switzerland.

*Primary Examiner* — Erin E McGrath
(74) *Attorney, Agent, or Firm* — Price Heneveld LLP

(57) ABSTRACT

A system for warming up and/or cooking food is provided herein and includes: a frame; operating means for heating an active zone defined within the volume delimited by said frame; an emitter device for irradiating said active zone with incident microwaves; a detector device for detecting corresponding radiations coming from said active zone; a first transmission unit associated with at least said detector device and configured for sending first data, representative of said corresponding radiations, to a processing unit.

16 Claims, 3 Drawing Sheets

(58) Field of Classification Search
USPC ..... 219/702
See application file for complete search history.

(56) References Cited

U.S. PATENT DOCUMENTS

| | | | | |
|---|---|---|---|---|
| 4,520,250 | A * | 5/1985 | Ishihara | H05B 6/6411 219/703 |
| 2009/0321428 | A1 | 12/2009 | Hyde et al. | |
| 2010/0187224 | A1 | 9/2010 | Hyde et al. | |
| 2013/0080098 | A1 * | 3/2013 | Hadad | H05B 6/6441 702/66 |

* cited by examiner

SYSTEM FOR WARMING UP AND/OR COOKING FOOD WITH MICROWAVE DETECTION

FIELD OF THE INVENTION

The present invention relates to a system for warming up and/or cooking food with microwave detection.

PRIOR ART

As is known, preparing food by means of an oven poses a number of problems: since food is cooked in a closed environment, it is always difficult to tell when cooking is complete. In fact, although ovens are usually provided with a door that is at least partially transparent, and with lighting means mounted inside the oven itself, evaluating the actual degree of cooking is still a complex operation.

Moreover, when the user tries to overcome this problem by opening the door to directly observe the food, he/she will risk to interrupt the cooking cycle in an uncontrolled manner, thus making the continuation of the same more difficult and less deterministic, while also risking burns and scalds caused by the high temperature that can be reached inside the oven in operation.

SUMMARY OF THE INVENTION

The present invention aims at providing a system which can solve the above-mentioned problems.

In particular, it is one object of the invention to provide a system which allows a more reliable evaluation of the degree of cooking of food being prepared, without requiring that the oven door be opened.

This and other objects are substantially achieved by a system in accordance with the appended claims.

A basic idea of the present invention is to envisage that the characteristics of the food being cooked in the oven can be detected through a microwave system and made available to the user.

The user can then verify the food cooking conditions, and possibly intervene in order to modify/stop the operation.

The user can also obtain some additional information, e.g., concerning food quality and composition, etc.

The invention therefore relates to a system for warming up and/or cooking food, comprising:

a frame; operating means for heating an active zone defined within the volume delimited by said frame;

an emitter device for irradiating said active zone with incident microwaves; a detector device for detecting corresponding radiations coming from said active zone; and a first transmission unit associated with at least said detector device and configured for sending first data, representative of said corresponding radiations, to a processing unit.

Preferably, said corresponding radiations are generated by the interaction between said incident microwaves and food present in said active zone.

Preferably, said processing unit is configured for generating, based on said first data, one or more images representative of food present in said active zone.

Preferably, said processing unit is configured for determining, based on said first data, one or more of the following characteristic parameters:

a. a first parameter representative of the quality of the food present in the active zone;

b. a second parameter representative of a freshness of the food present in the active zone;

c. a third parameter representative of the volume occupied by the food present in the active zone;

d. a fourth parameter representative of the cooking level of the food present in the active zone; and e. a set of parameters representative of a composition of the food present in said active zone, preferably comprising values concerning the relative quantity of skin and/or the relative quantity of meat and/or the relative quantity of water and/or the relative quantity of stuffing.

Preferably, said system further comprises a second transmission unit for sending second data to a display device.

Preferably, said second data comprise said one or more images.

Preferably, said second data comprise one or more of said characteristic parameters.

Preferably, said frame, said operating means, said emitter device, said detector device and said first transmission unit are parts of an oven.

Preferably, said oven is of the combined type.

Preferably, said emitter device is configured for being brought into an alternative operating condition in which it is adapted to warm up the food present in said active zone.

Preferably, said processing unit and said second transmission unit are integrated into said oven.

Preferably, said display device is integrated into a portable auxiliary device separate from said oven.

Preferably, said processing unit and said second transmission unit are integrated into a portable auxiliary device separate from said oven.

Preferably, said display device is integrated into said auxiliary device.

Further features and advantages will become more apparent from the following detailed description of a preferred but non-limiting embodiment of the invention.

BRIEF DESCRIPTION OF THE DRAWINGS

Said description will refer to the annexed drawings, also provided merely as explanatory and non-limiting examples, wherein.

The drawings show different aspects and embodiments of the present invention and, where appropriate, similar structures, components, materials and/or elements are designated in the various drawings by the same reference numerals.

DETAILED DESCRIPTION OF THE PREFERRED EMBODIMENTS

Figure 1:
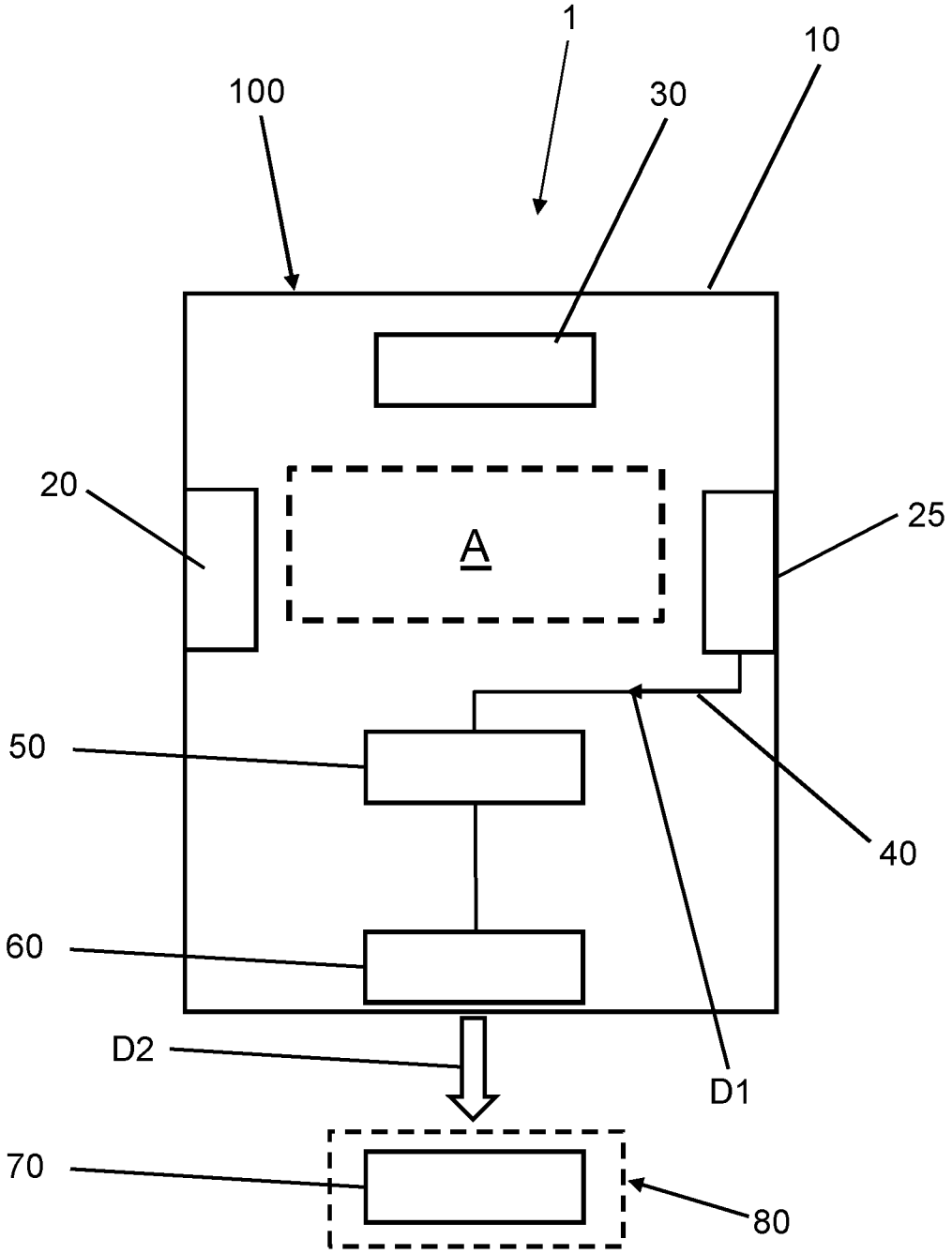
FIG. 1 is a block diagram representative of a first embodiment of a system according to the invention.

With reference to the annexed drawings, reference numeral 1 designates as a whole a system for warming up and/or cooking food in accordance with the present invention.

Figure 2:
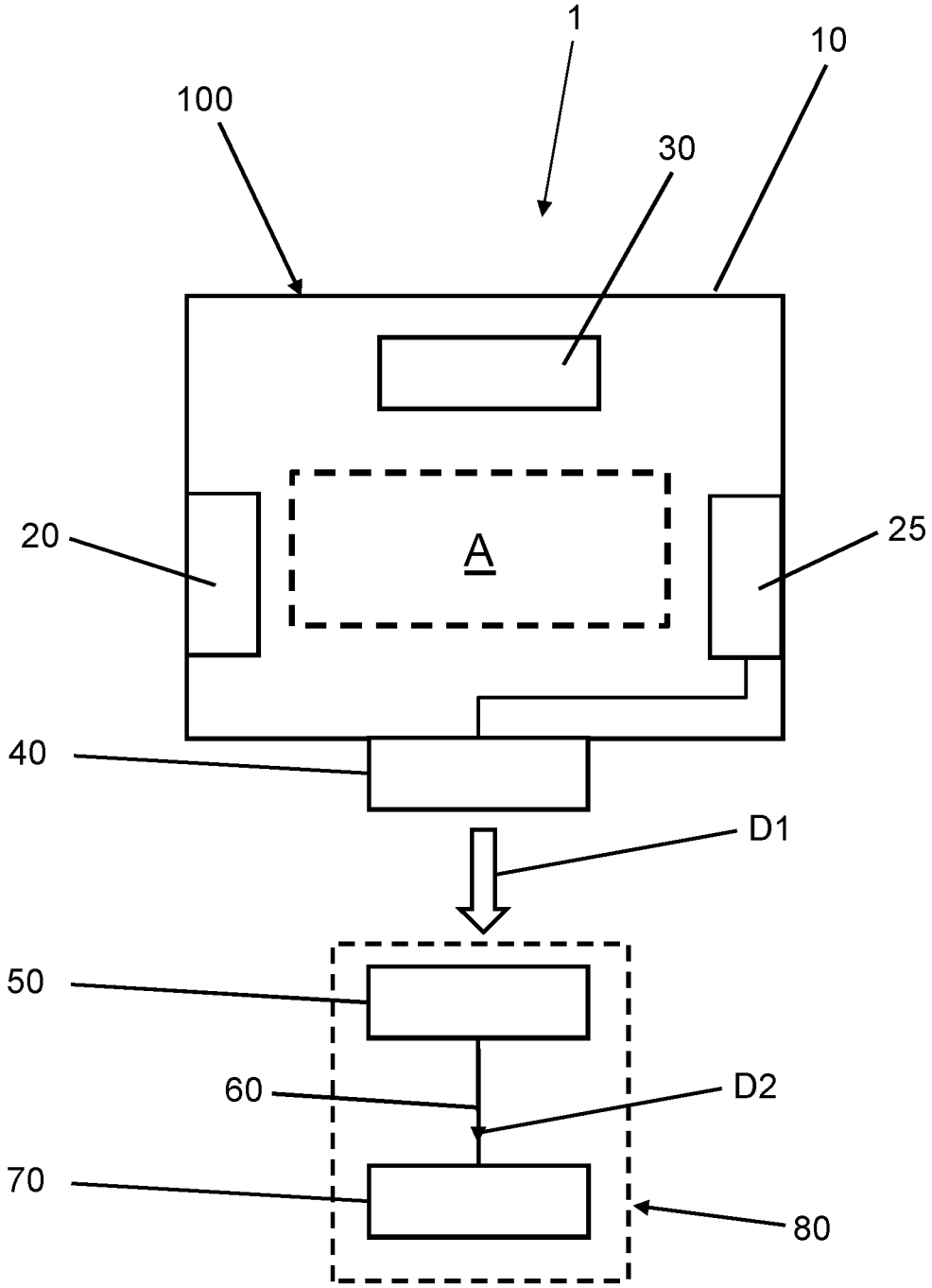
FIG. 2 is a block diagram representative of a second embodiment of a system according to the invention.

The system 1 (FIGS. 1, 2) comprises, in the first place, a frame 10. The frame 10 has a box-like shape, preferably a parallelepiped shape.

Preferably, the frame 10 is provided with a door that can be opened/closed in order to selectively allow access to the inside of the volume delimited by said frame 10.

The system 1 is also provided with operating means 30 for heating an active zone A defined within the internal volume of said frame 10.

Preferably, the active zone A is delimited by the so-called muffle, which is per se known and will not therefore be described any further herein.

The operating means 30 may comprise, by way of example, one or more electric resistors and one or more ventilation ducts. These features, which are per se known, will not be described any further.

In accordance with the invention, the system 1 further comprises an emitter device 20 for irradiating said active zone A with incident microwaves.

Such microwaves advantageously have a wavelength between 0.1 m (corresponding to a frequency of approx. 2-3 GHz) and 0.001 m (corresponding to a frequency of approx. 300 GHz).

The microwaves generated by the emitter device 20 act upon the food present in the active zone A.

Following said interaction, corresponding radiations are generated, which are conveniently detected by a detector device 25 included in the system 1.

Such corresponding radiations may comprise microwaves and/or infrared radiations and/or any other radiations deriving from the interaction between the incident microwaves and the food present in the active zone A.

The system 1 further comprises a first transmission unit 40 associated with at least said detector device 25 and configured for sending first data D1 to a processing unit 50.

Such first data D1 are representative of the radiations detected by said detector device 25.

Preferably, the processing unit 50 is configured for generating, based on said first data D1, one or more images X representative of food present in the active zone A.

In addition or as an alternative, the processing unit 50 is configured for determining, based on said first data D1, one or more of the following characteristic parameters Y:

a. a first parameter representative of the quality of the food present in the active zone;

b. a second parameter representative of a freshness of the food present in the active zone;

c. a third parameter representative of the volume occupied by the food present in the active zone;

d. a fourth parameter representative of the cooking level of the food present in the active zone; and e. a set of parameters representative of a composition of the food present in said active zone, preferably comprising values concerning the relative quantity of skin and/or the relative quantity of meat and/or the relative quantity of water and/or the relative quantity of stuffing.

Advantageously, the first data D1 are representative of a spectral absorption of the food present in the active zone A, and allow the processing unit 50 to make the above-mentioned calculations.

Preferably, the system 1 further comprises a second transmission unit 60 for sending second data D2 to a display device 70.

The display device 70 is advantageously integrated into a portable auxiliary device 80.

The second data D2 may comprise the above-mentioned one or more images X and/or one or more of the above-mentioned characteristic parameters Y.

Conveniently, the frame 10, the operating means 30, the emitter device and the detector device are parts of an oven 100.

In particular, the oven 100 is of the combined type, wherein the emitter device 20 is also configured for being brought into an alternative operating condition in which it is adapted to warm up the food present in the active zone A.

In other words, the oven 100 may be able to warm up or cook food by using the operating means 30 and/or the emitter device 20. Advantageously, the latter is also configured for emitting radiations within the microwave range for analyzing the food present in the active zone A.

In one embodiment, both operations (food warming/cooking by microwaves and food analysis) can be carried out substantially at the same time: the radiations emitted by the emitter device 20 act upon the food, causing it to get warmed up and/or cooked. The corresponding radiations (e.g., within the microwave range) emitted by the food can be detected by the detector device 25, so that the first data D1 can be sent to the processing unit 50 through the first transmission unit 40 to allow analyzing the food during the preparation of the same.

In one embodiment (FIG. 1), the processing unit 50 and the second transmission unit 60 are integrated into said oven 100.

In this case, the first transmission unit 40 may comprise a simple wiring for connecting the detector device 25 to the processing unit 50. Most of the processing will then be carried out within the oven 100 itself. The second transmission unit 60, instead, will use wireless technology (e.g., Wi-Fi) for sending the second data D2 to the display device 70.

In a different embodiment (FIG. 2), the processing unit 50 and the second transmission unit 60 are integrated into the above-mentioned portable auxiliary device 80, separate from the oven 100.

In this case, the first transmission unit 40 will use wireless technology (e.g., Wi-Fi) for sending the first data D1 to the processing unit 50. The analysis will be carried out internally to the auxiliary device 80, and the second transmission unit 60 may comprise a simple wiring for connecting the processing unit 50 to the display device 70.

In the preferred embodiment, the auxiliary device 80 is a smartphone or a tablet, which can be connected to multiple apparatuses or household appliances within a household environment.

Figure 3:
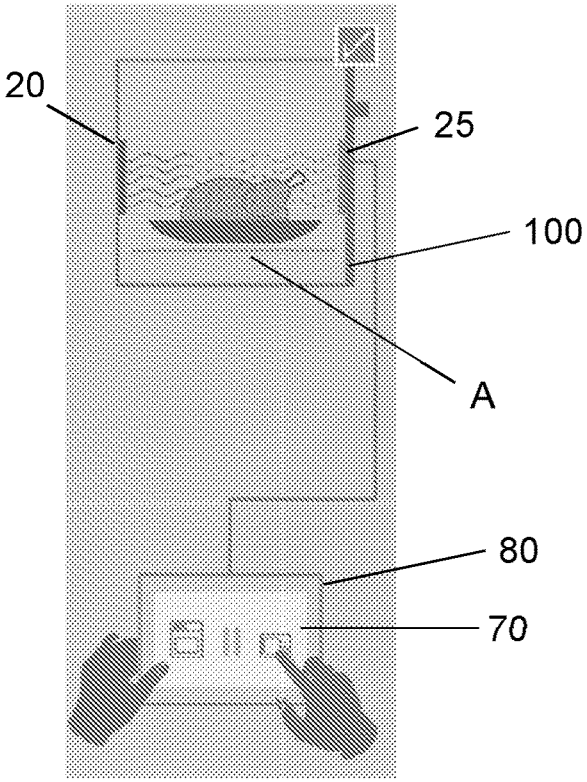
FIGS. 3-5 schematically show operating conditions of the system of FIGS. 1-2.

Suitable software (a so-called app) will allow the user to select the apparatus or system to interface to (e.g., the system 1). FIG. 3 schematically shows the selection operation.

Figure 4:
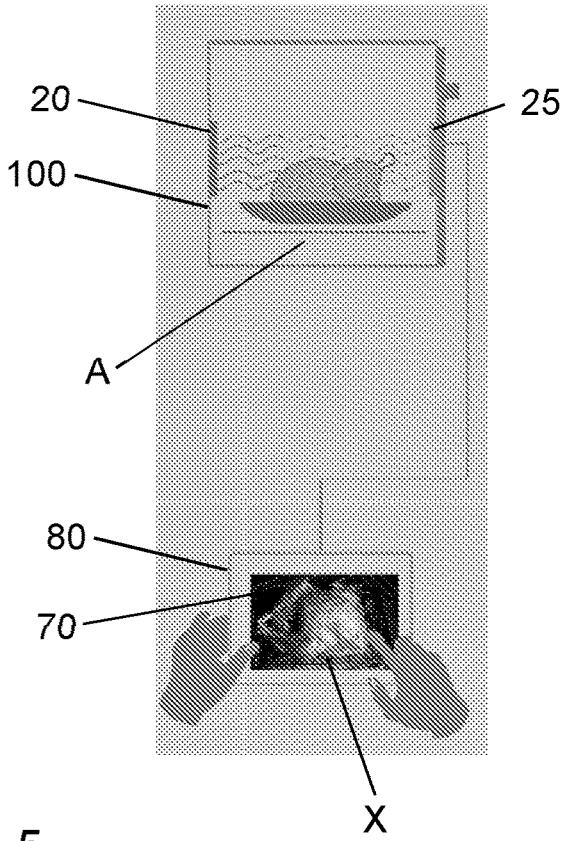
Figure 5:
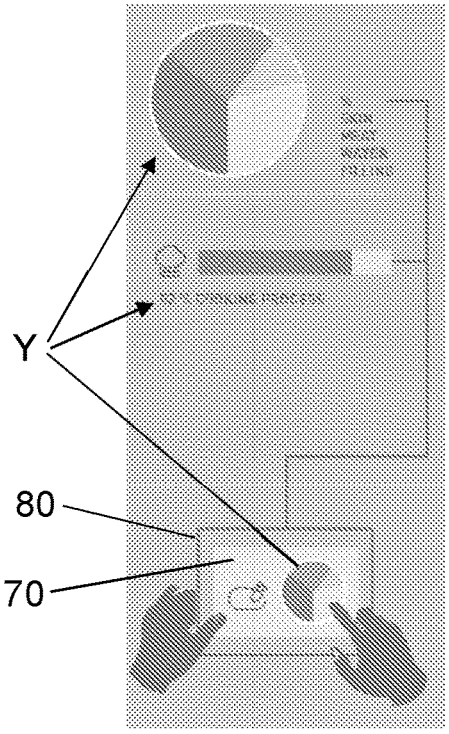

In the case wherein the above-mentioned processing unit 50 is integrated into the auxiliary device 80, said app is also configured for carrying out the above-described processing, so as to make available to the user said one or more images X (FIG. 4) and/or one or more of said characteristic parameters (FIG. 5).

The invention offers significant advantages.

The system according to the invention allows, in fact, a more reliable evaluation of the cooking condition of the food being prepared, without requiring the oven door to be opened.

In addition, the invention allows the user to evaluate the conditions of the food positioned inside the oven, without even needing to be in proximity to the latter.

The invention claimed is:

1. An oven, comprising:

a frame;

an electric resistor for heating an active zone defined within a volume delimited by the frame;

a microwave emitter for irradiating the active zone with incident microwaves;

a radiation detector configured to detect separate corresponding radiations coming from the active zone, wherein the separate corresponding radiations are generated in response to the incident microwaves acting upon food present in the active zone, wherein the separate corresponding radiations differ from the incident microwaves with at least some of the separate corresponding radiations having a different wavelength compared to the incident microwaves, and wherein the radiation detector is configured to detect the separate corresponding radiations concurrently with emission of the incident microwaves; and a processor operably coupled to the radiation detector, wherein the processor receives radiation data from the radiation detector related to the separate corresponding radiations and is programmed to determine a parameter representative of a freshness of the food present in the active zone using the radiation data, wherein the processor is also programmed to determine a set of parameters representative of a quantity of skin, a quantity of meat, and a quantity of stuffing in the food in the active zone using the radiation data, and wherein the detected corresponding radiations are representative of spectral absorption of the incident microwaves by the food.

2. The oven of claim 1, wherein the separate corresponding radiations include microwave radiation and infrared radiation.

3. The oven of claim 1, wherein the processor generates one or more images representative of the food present in the active zone based on the separate corresponding radiations.

4. The oven of claim 1, wherein the processor determines, based on the radiation data, at least one of the following characteristic parameters:

a parameter representative of a volume occupied by the food present in the active zone; and a parameter representative of a cooking level of the food present in the active zone.

5. The oven of claim 1, wherein the processor sends data to a display device via at least one of wired and wireless technology.

6. The oven of claim 5, wherein the data comprises one or more images representative of the food present in the active zone.

7. The oven of claim 5, wherein the data sent to the display device comprises one or more of the following characteristic parameters:

a parameter representative of a freshness of the food present in the active zone;

a parameter representative of a volume occupied by the food present in the active zone;

a parameter representative of a cooking level of the food present in the active zone; and a set of parameters representative of a composition of the food present in the active zone, comprising values concerning a relative quantity of skin, a relative quantity of meat, a relative quantity of water, and a relative quantity of stuffing.

8. The oven of claim 1, wherein said oven is of a combined type of oven, wherein the microwave emitter is configured for being brought into an operating condition in which the combined type of oven warms up the food present in the active zone and an operating condition for cooking the food present in the active zone.

9. The oven of claim 1, further comprising:

a transmission unit that utilizes at least one of wired and wireless technology integrated into said oven and configured to send data to a display device.

10. The oven of claim 9, wherein said oven is operably coupled to the display device integrated into a portable auxiliary device separate from said oven.

11. The oven of claim 1, wherein said oven is operably coupled to a transmission unit integrated into a portable auxiliary device separate from said oven, wherein the transmission unit utilizes wireless technology.

12. The oven of claim 11, wherein a display device is integrated into the portable auxiliary device.

13. The oven of claim 1, wherein the separate corresponding radiations are infrared radiations.

14. The oven of claim 1, wherein the processor is programmed to generate one or more images representative of a composition of the food present in the active zone, and wherein the composition includes the quantity of meat, a quantity of water, the quantity of skin, and the quantity of stuffing.

15. The oven of claim 14, wherein the processor is programmed to send data to a display device, wherein the display device is configured to display the one or more images of the representative the composition of the food present in the active zone based on the data received from the processor.

16. The oven of claim 5, wherein the data sent to the display device comprises:

a parameter representative of a freshness of the food present in the active zone; and a set of parameters representative of a composition of the food present in the active zone, comprising values concerning a relative quantity of skin, a relative quantity of meat, a relative quantity of water, and a relative quantity of stuffing.

* * * * *